United States Patent [19]

Walters et al.

[11] Patent Number: 4,587,735

[45] Date of Patent: May 13, 1986

[54] KNIFE GUARD

[76] Inventors: Charles J. Walters, 14636 S. Keystone, Midlothian, Ill. 60445; David Plahm, P.O. Box 283, Worth, Ill. 60482

[21] Appl. No.: 692,427

[22] Filed: Jan. 18, 1985

[51] Int. Cl.[4] ..... B26B 29/02

[52] U.S. Cl. ..... 30/286; 30/2; 30/153; 30/294

[58] Field of Search ..... 30/286, 294, 295, 151, 30/2, 153

[56] References Cited

U.S. PATENT DOCUMENTS

| | | | |
|---|---|---|---|
| 1,320,191 | 10/1919 | Ash | 30/286 X |
| 2,644,230 | 7/1953 | Anderson | 30/2 X |
| 2,730,800 | 1/1956 | Bailey | 30/2 |
| 2,743,523 | 5/1956 | Honey | 30/286 |
| 3,781,988 | 1/1974 | Jones | 30/2 |
| 4,087,911 | 5/1978 | Schrock | 30/286 |
| 4,106,196 | 8/1978 | Smithline | 30/294 |

*Primary Examiner*—Jimmy C. Peters

*Attorney, Agent, or Firm*—Gary, Juettner & Pyle

[57] ABSTRACT

A knife guard suitable for various type cutting or chopping blades is provided and utilizes a plurality of elongated members which are hinged together and biased by the hinges and/or separate a biasing arm toward a first closed position wherein at least one of the elongated members covers or protects the blade. The guard can be moved to a stable, second open position wherein the one elongated element is moved out in front of the blade, but yet can move quickly back into its closed first position to prevent unintentional injury or damage.

19 Claims, 8 Drawing Figures

KNIFE GUARD

This invention relates to a blade/knife guard, and more particularly to a blade/knife guard which snaps between a closed, protective position and an open, cutting position.

BRIEF SUMMARY OF THE INVENTION

Heretofore various knife or blade guards have been developed, particularly for special purposes. For example, U.S. Pat. No. 1,222,366 shows a sheet metal guard mounted on a mechanical spring attached to the knife's handle; U.S. Pat. No. 1,299,084 shows a knife for butchering operations with a pivoting guard; U.S. Pat. No. 2,025,305 shows a furrier's knife with guarding portions; U.S. Pat. No. 2,743,523 shows a carton cutting knife with a resilient metal clip which functions as a knife guard; U.S. Pat. No. 2,882,598 shows a knife with a guard adapted for slitting envelopes; and U.S. Pat. No. 3,457,643 shows a hobby type knife fitted with a guard adapted for cutting wire ties. While various type guards have heretofore been developed, none was easily adapted to common knives; some were expensive to manufacture, were difficult to use, and generally were either fixed in place restricting use of the blade and/or offered reasonable protection in its closed position, but no or only marginal protection in its other position, when the blade was exposed for cutting.

These disadvantages have been overcome by a blade/knife guard of the present invention. For simplicity, the guard of the present invention will hereafter normally be merely referred to as a knife guard, and it is understood that term encompasses any blade guard, and "knife" would include any cutting or chopping device that the present invention may be adapted to, such as any cutting device, axe, chisel, etc.

The knife guard of the present invention comprises a mounting portion for attaching the guard to a knife, and elongated elements which are hinged together permitting the elements to move between two positions, a first, closed position wherein at least one of the elongated elements extends before the cutting edge of the knife to cover the edge and protect the user, and a second, open position wherein said one elongated element moves away from the cutting edge in a manner to expose the cutting edge of the blade for use. Preferably the elongated elements and hinges are arranged to provide and cooperate with spring means so that the guard will snap or spring between the two positions but yet remain stable in one or the other of these positions.

One of the unique features of the knife guard of the present invention is that even when in the open position it affords the user additional protection as the guard is capable of springing back to cover the cutting edge should the guard strike an object not intended to be struck. This particular advantage of the knife guard of the present invention is achieved by positioning the protecting elongated element in the open position out in front of the cutting edge. Thus, should the guard strike an object not intended to be cut, such as the finger of the person using the knife or some material object not intended to be cut, the guard immediately snaps from its open position to its closed position to cover the cutting edge of the blade and prevent an injury. Thus the guard of the present invention, unlike many prior art devices, protects in both of its open and closed positions.

The knife guard of the present invention is inexpensively made of a flexible, resilient material, such as rubber or plastic (polypropylene being suitable) by an inexpensive process, such as injection molding.

It is the primary object of the present invention to provide a knife guard which can be used to protect the cutting edge of a blade of a knife.

Another object of the present invention is to provide a knife guard which is made of inexpensive flexible, resilient material by an inexpensive process suitable for mass production.

Yet another object of the knife guard of the present invention is to provide protection in both its open and closed positions and reduce the possibility of injury.

A further object of the knife guard of the present invention is to provide a construction which causes the knife guard to snap to its open or closed position, and particularly from its open to closed position to prevent injury and damage from cutting unintended objects or the user's fingers.

Still a further object of the knife guard of the present invention is to provide a construction which can be easily adapted to various type knives, such as hobby knives, utility knives, single and double edge razor blades, or other cutting or chopping devices such as axes, chisels, etc.

These and other objects of the present invention will become apparent from the following written description and the accompanying figures of the drawings.

DESCRIPTION OF THE PREFERRED EMBODIMENTS

Figure 1:
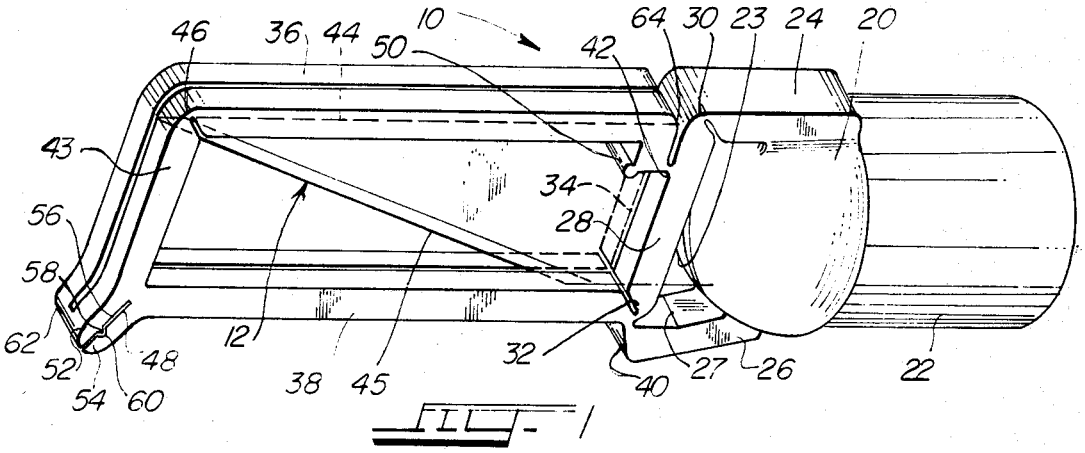
FIG. 1 is a perspective view of a first embodiment of the knife guard of the present invention shown in a first (closed) position protecting the blade of a hobby knife.

The knife guard of the present invention can be adapted to various cutting tools. For illustration purposes, the first embodiment of the knife guard 10 is shown in FIG. 1 in a form for use with a hobby knife, such as sold under the trademark "Xacto". This type knife has a blade 12 held in a member (not shown) having a slot (not shown), the slot being squeezed closed by screwing a threaded portion (not shown) of the member into the handle (not shown), the slotted member and handle having a collar (not shown) therebetween which squeezes the slot to retain the blade to the handle.

Referring to FIG. 1, the knife guard 10 comprises an attaching portion, in this instance a hemispherical cap 20 and a cylindrical portion 22 which fits over the operative blade carrying end of the hobby knife. The cap 20 has a blade slot 23 therein to permit the blade 12 to extend therethrough. Extending outwardly from the cap 20 is a semi-rigid support arm 24 and a spring or extension arm 26, which acts as a biasing means and has a slightly narrowed center section 27 to facilitate the spring action. Both ends of the arms 24 and 26 adjacent the cap 20 are relatively solidly affixed thereto so as to permit little relative movement of the respective inner ends of the arms attached to the cap. Generally the support arm 24 extends a short distance away from and parallel to the axis of the knife handle, while the extension arm 26 extends at a small angle to the axis. An inner, elongated cross member 28 is connected via hinged joint 30 to arm 24 and hinged joint 32 to another longer elongated member 38, which forms part of the protection for the blade, near the junction with the arm 26. Cross member 28 also is slotted, as indicated at 34, to permit the blade 12 to extend therethrough. The elongated member 38 is hingedly connected at its inner end to the extension arm 26 by an additional hinged joint 40. A second longer elongated member 36 is generally spaced from member 38 a distance somewhat greater than the width of the blade 12 and at one end is connected to the cross member 28 by a hinged joint 42. The two elongated members 36 and 38, as shown in FIG. 1, lie generally parallel to each other, the axis of the knife, and the non-cutting edge 44 of the blade 12, the cutting edge 45 for this type blade lying generally transverse (diagonally) to the elongated members 36 and 38. While only one blade type for the hobby knife is shown, the knife guard of the present invention has been sized to accommodate various type hobby knife type blades. The other ends of the elongated members 36 and 38 are again hingedly joined to a second, outer elongated cross member 43 by two hinges 46 and 48. Thus, the hinged members 28, 36, 38 and 43 form a hinged trapezoidal structure (or four bar linkage) capable of being displaced from the position shown in FIG. 1, with the guard closed so as to protect or cover the cutting edge 45 of the blade 12, to the position shown in FIG. 2, with the guard open so as to expose the cutting edge 45 of the blade 12 for use.

Figure 2:
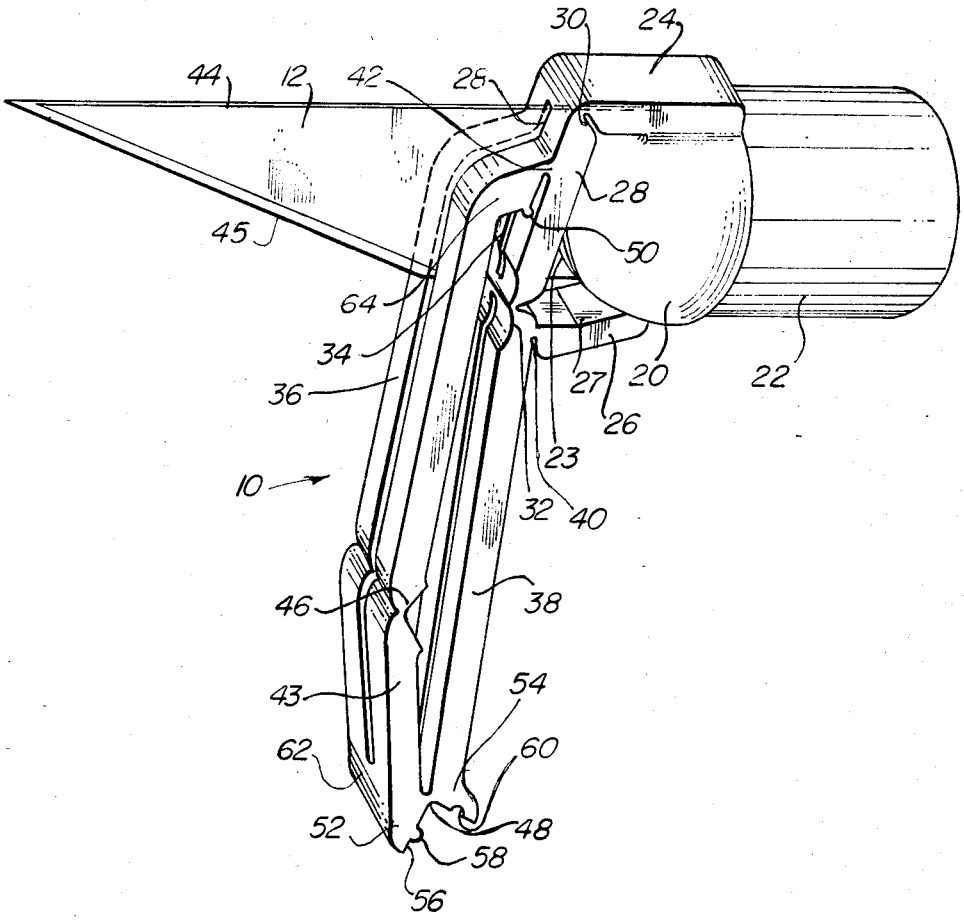
FIG. 2 is a perspective view of the knife guard of FIG. 1 shown in a second (open) position exposing the blade of the hobby knife for cutting.

As is apparent from FIG. 1, the hinged joints 30, 32, 40, 42, 46 and 48 are simply formed by narrowed sections, such that they permit relative movement of the adjacent members forming the trapezoid formed by members 28, 36, 38 and 43 surrounding the blade. In order to limit the movement of this trapezoidal linkage, a cylindrical stop 50 is provided adjacent the hinged end 42. As is shown in FIG. 2 when the guard is moved to its open position this stop 50 will engage with the inner elongated cross member 28 to limit the guard's movement, help define the open position, and support the blade guard in that position. Further, one end of the outer elongated cross member 43 and the adjacent end of one of the elongated member 38 are provided with extended portions 52 and 54 which are separated or divided by a cut 56 extending up to the narrow hinged joint 48. One margin of the cut 56 is provided with a male protrusion 58, while the other side of the cut 56 is provided with a receptive female groove 60. The protrusion 58 and groove 60 cooperate with one another so as to form a snap joint to help retain and stabilize the guard in its close, FIG. 1 position.

As is apparent from FIGS. 1 and 2, the elongated members 36 and 38 and cross members 28 and 43 each have a complementary portion or one half on each side of the blade, the halves being separated by a long slot to accommodate travel of the guard past the blade. However, with certain type blades not all elongated members need be split in half. For example, members 38 and 43 need not be so split in half but each could be one piece. The halves of the cross member 43 and elongated members 36 are joined or held to their respective halves at the tip 62 of the extensions 52 and 54 to hold the guard together. The other, inner ends of the halves elongated members 36 and 38 are held slightly spaced apart about the thickness of the blade via the hinges 40 and 42 to the cross member 28, and the latter at its ends is connected to the arms 24 and 26.

As the entire knife guard is made by an inexpensive process, such as injection molding, from one material, the material chosen must have sufficient rigidity to give the cap, arms, elongated and cross members structural substance, but yet permit the necessary movement of the narrowed hinged joints. A suitable, resilient, flexible material is polypropylene. Also various rubber-like materials would also be suitable.

Referring to FIG. 2, as is illustrated, the knife guard has been displaced to its second or open position wherein the cutting edge 45 of the blade is exposed for use. Here the cross member 43 and elongated member 36, lie in nearly linear alignment and parallel to the elongated member 38 and cross member 28, the latter two also being in nearly linear alignment. As was stated earlier, the cylindrical stop 50 abuts the cross member 28 to limit the extent of this movement. As the elongated member 38 moves toward the position shown in FIG. 2, it causes the spring or extension arm 26 to be displaced (downwardly from its FIG. 1 position). Thus, the cross arm 28 and elongated member 38 pass through a stage where they are in linear alignment and are finally positioned slightly over-center so that the tendency of the arm 26 to return to its FIG. 1 position tends to hold the guard in its FIG. 2 position. Any slight relative movement of the guard's elongated members (clockwise as shown in FIG. 2), such as caused by inadvertently striking the user's fingers or any other materials not intended to be cut, causes the elongated member 38 to pass through its center position and the arm 26 in returning to its FIG. 1 position then drives the guard swiftly back to its closed, FIG. 1 position to prevent injury. In addition to the force provided by the displaced arm 26 to return the guard to its FIG. 1 position, at least some additional force for such purposes is provided by one or more of the various hinge joints connecting the various arms and cross and elongated members. These hinge joints if in their displaced FIG. 2 positions also tend to return to their normal FIG. 1 position in which they may have been originally molded.

Of course in returning to its FIG. 1 position, the guard is prevented from overshooting that position by engagement, if need be, of the short leg 64 of the elongated member 36 with the upper end of cross member 28. In the same manner, this same contact insures that the guard can only move from its closed FIG. 1 position to its open FIG. 2 position. The blade 12 itself cooperates with the adjacent internal sides of the elongated members 36 and 38 and cross members 28 and 43 to guide the guard downwardly to the FIG. 2 position and to return therefrom to the FIG. 1 position. Of course, the elongated member 38 and cross member 43 serve to shield the cutting edge 45 when the guard is in its closed position.

In the FIGS. 1 and 2 embodiment to hold the guard 10 to the knife, the cap 20 is made integral with the cylindrical portion 22 which fits tightly around the corresponding cylindrical portion of the hobby knife. Alternative means for holding the guard to the knife are shown in FIGS. 3 through 7.

Figure 3:
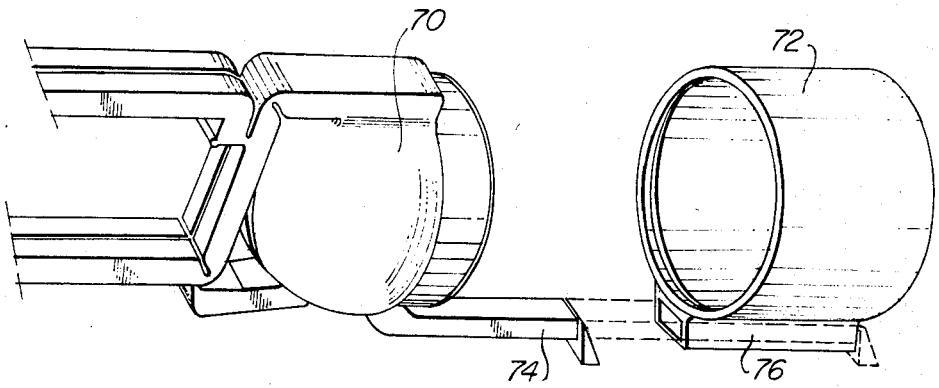
FIG. 3 is a perspective view of a first alternative embodiment for attaching the knife guard to the hobby knife.

In FIG. 3, the cap 70 is not integral with the sleeve 72 but is separate therefrom. The sleeve 72 is secured to the knife and the cap attached to the sleeve by the bayonet means comprising the bayonet like portion 74 which is cooperatively received in the female sheath 76. Of course the male and female elements could also be reversed.

Figure 4:
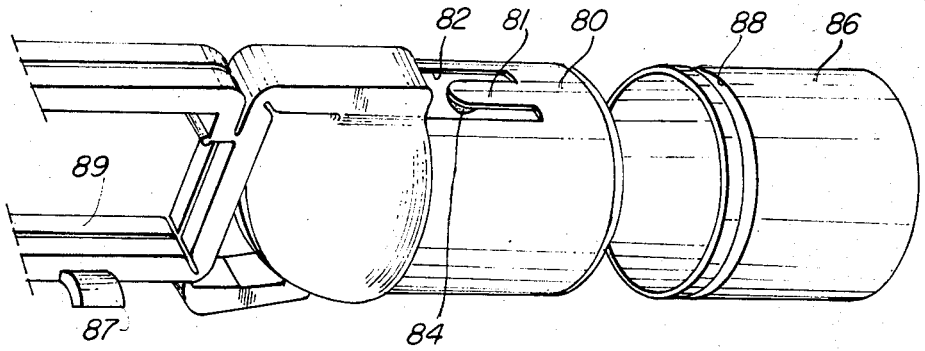
FIG. 4 is a perspective view of a second alternative embodiment for attaching the knife guard to the hobby knife.

In FIG. 4, the cap has an outer sleeve portion 80 with a tab 81 thereon extending from the margins of an opening 82, the inner end of the tab having an inwardly extending protuberance 84. The outer sleeve portion 80 fits over an inner sleeve portion 86 attached to the knife. This inner sleeve portion 86 has an annular groove 88 on its perimeter into which the protuberance 84 fits to lock the two sleeves 80 and 86 together to hold the guard to the knife. Alternatively, the groove 88 could be provided in the knife itself, and the protuberance then would engage directly therewith, dispensing with the inner sleeve 86. Of course in versions where there are inner and outer sleeves, with minor changes in construction the one carrying the guard could be either.

In addition anti-roll means in the form of extending portions 87 have been molded on the elongated element 89 so as to prevent the hobby knife from rolling when placed down on a flat surface.

Figure 5:
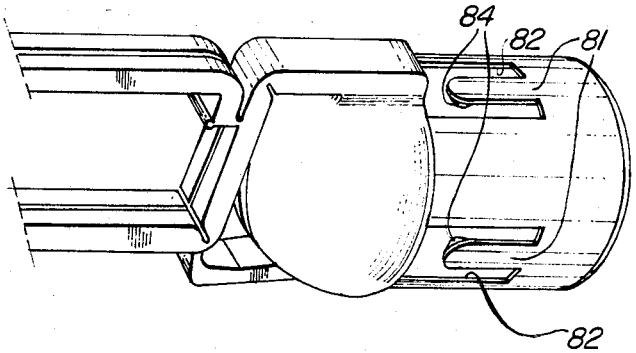
FIG. 5 is a perspective view of a third alternative embodiment for attaching the knife guard to the hobby knife.

The embodiment shown in FIG. 5 is very similar to that shown in FIG. 4. The principal differences is that to further secure the guard, a plurality of tabs 81 with protuberances 84 in openings 82 are provided and engage the peripheral groove in several locations on its circumference.

Figure 6:
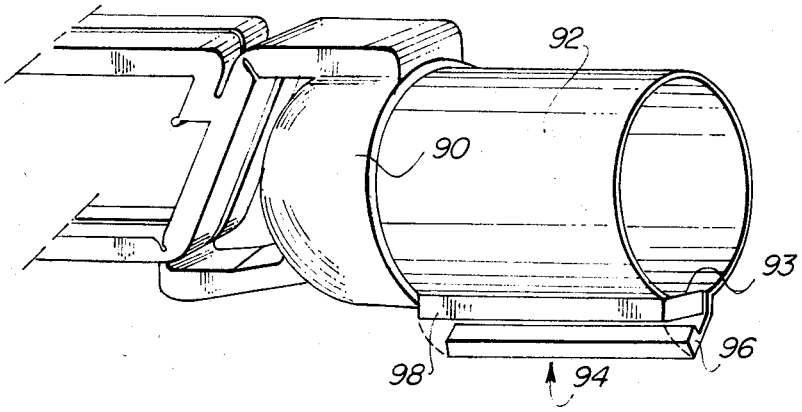
FIG. 6 is a perspective view of a fourth alternative embodiment for attaching the knife guard to the hobby knife.

Referring to FIG. 6 the guard is shown attached to a cap 90 which in turn is attached to a sleeve 92. The sleeve 92 is split axially (indicated at 93) on its surface, and the respective margins thereof are provided with clamping means 94 in the form of a pivotal male portion 96 on one edge which engages in a female receiving channel on the adjacent edge 98. Of course other clamping means could also be used. The sleeve 92 is sized so that when the clamping means 94 is closed, the sleeve tightly grips the hobby knife to retain the guard thereto.

Figure 7:
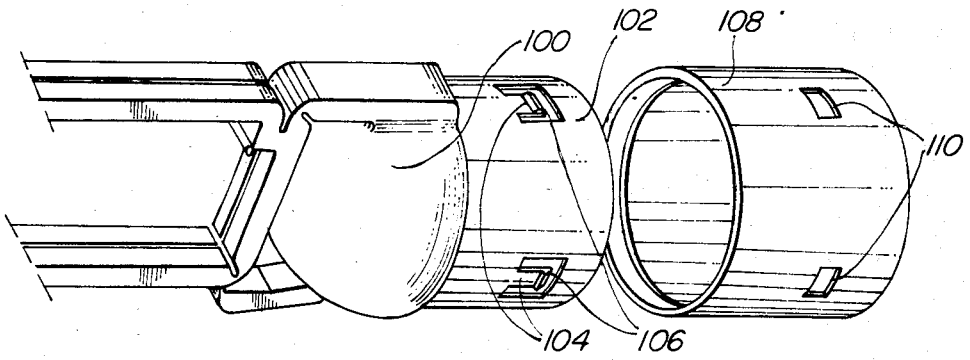
FIG. 7 is a perspective view of a fifth alternative embodiment for attaching the knife guard to the hobby knife.

Referring to FIG. 7, the guard is carried by a cap 100 which is attached to an inner sleeve 102. The inner sleeve carries tabs 104, one or more of which themselves have radially outwardly extending protuberances 106. The sleeve 102 fits within an outer sleeve 108 which is secured to the knife. The sleeve 102 has a corresponding number of openings 110 for receiving the protuberances 106 which cooperate with the margins of the openings 110 to hold the guard, cap 100 and inner sleeve 102 to the outer sleeve 110 and consequently to the knife.

Figure 8:
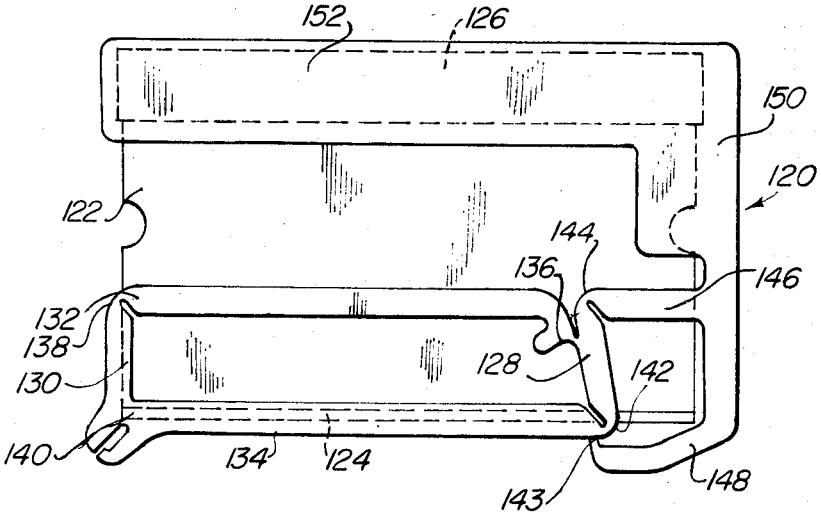
FIG. 8 is an elevational view of another embodiment of the knife guard of the present invention shown in its first (closed) position protecting the cutting edge of a razor blade.

Referring to FIG. 8, another embodiment 120 of the knife guard of the present invention is shown adapted to fit on a razor blade 122. In this instance the razor blade is of the single edge type having a cutting edge 124 and protected or safety edge 126. As is shown the four trapezoidal members, cross arms 128 and 130 and elongated members 132 and 134 are similarly connected by hinged joints 136, 138, 140, and 142, and the outer ends of two arms 146 and 148 are secured via the hinge joints 143 and 144. The inner ends of the arms 146 and 148 are connected to an attaching portion 150 which has a cap 152, in turn snapping snugly over the protected edge 126 of the razor blade. The operation of this guard is similar to that described for the guard shown in FIGS. 1 and 2 and will not be more fully described.

The present invention, due to its unique use of small dimensioned members spaced relatively widely apart, in comparison to their thickness, results in a minimum use of material in constructing each knife guard. As a result, the knife guards of the present invention can be inexpensively manufactured as material costs are low, and/or higher quality materials may be used as the volume of material needed is low.

It should be appreciated that the guard of the present invention could be adopted to any cutting tool such as an axe, chisel or any other type knife, such as a utility knife. For example the guard could be attached to a cap or sleeve which slipped over the handle of the utility knife just adjacent the blade. Further the guard for some type knives could be held thereto merely by a snug fit of a sleeve carrying the guard around a portion of the knife. Such sleeve could be a tight fitting unbroken cylinder, or if desired, a portion of it slit lengthwise to provide some additional flexing of the sleeve to make it easier to fit onto the knife. Of course it is understood that the knife guard of the present invention could be retrofitted to existing knives or cutting device and/or built in as a part of any new knife.

While various embodiments of the blade or knife guard of the present invention have been described and illustrated, it should be understood that various modifications could be made or equivalent structure substituted and that such would still fall within the scope of the appended claims.

What is claimed is:

1. A knife guard for the cutting edge of a blade of a knife or the like, comprising an attaching means for attaching the kinfe guard to the kinfe, guard means for covering the cutting edge of the blade of the knife, said guard means being positionable into two positions, a first position with said guard means shielding the cutting edge and a second position with said guard means removed from the cutting edge to expose the same for use, hinge means between said attaching means and guard means for permitting movement of said guard means between its two positions by one of engaging said knife guard with an object and manually, spring means cooperating with said attaching means and guard means for holding said guard means in either of its two positions, said guard means comprising two elongated members and two cross members, at least one of said members being attached to said attaching means, and at least some of said members being used to shield the cutting edge when in said first position, said two cross and two elongated members being connected to each other by hinged joint to form a trapezoid.

2. A knife guard as in claim 1, wherein at least one of said cross and elongated members has one or more slits therein through which the blade may pass for movement of said guard means between its first and second positions.

3. A knife guard as in claim 2, wherein both said cross and elongated members have slits therein through which the blade may pass.

4. A knife guard as in claim 1, wherein the knife is a hobby knife having a portion for holding the blade, said attaching means having a corresponding portion for engaging said portion of the hobby knife.

5. A knife guard as in claim 4, wherein said attaching means includes a first sleeve carry said guard means, and a second sleeve attached to said hobby knife, said first sleeve being held to said second sleeve by fastening means.

6. A knife guard as in claim. 5, wherein said fastening means is in the form of bayonet portion on one of said sleeves and a cooperating receiving sheath on the other of said sleeves.

7. A knife guard as in claim 5, wherein said fastening means comprises a grooved margin on one of said sleeves and one or more cooperating protuberances on the other of said sleeves.

8. A knife guard as in claim 4, said attaching means further comprising fastening means for attaching and holding the head of the knife.

9. A knife guard as in claim 4, further comprising anti-roll means for preventing the hobby knife from rolling unintentionally.

10. A knife guard as in claim 1, made of a flexible, elastic material.

11. A knife guard as in claim 1, made of polypropylene.

12. A knife guard as in claim 1, wherein said knife guard is adapted to be fitted to one of a hobby knife, razor blade, utility knife, kitchen knife, scalpel, axe or other cutting device.

13. A knife guard as in claim 12, wherein said attaching means is made an integral part of the knife.

14. A blade guard for the cutting edge of a razor blade or the line, comprising an attaching means for attaching the blade guard to the razor blade, guard means for covering the cutting edge of the razor blade, said guard means being positionable into two positions, a first position with said guard means shielding the cutting edge and a second position with said guard means removed from the cutting edge to expose the same for use, hinge means between said attaching means and guard means for permitting movement of said guard means hetween its two positions by one of engaging said blade guard with an object and manually, said guard means comprising a plurality of members arranged to form a trapezoid, one member forming said trapezoid being adopted to lie generally parallel to a cutting edge of the razor blade, two of the remaining members being attached by hinged joints to said one member, and the fourth member being attached to said two members by hinged joints, and means holding said members spaced apart when in said first position, and collapsed with two of the members generally parallel to the other two members when in said second position.

15. A knife guard as in claim 14, wherein said attaching means comprises an elongated cap having a groove therein for receiving the side of said razor opposited its cutting edge.

16. A knife guard for the cutting edge of a blade of a knife or the like, comprising an attaching means for attaching the knife guard to the knife, guard means for covering the cutting edge of the blade of the knife, said guard means being positionable into two positions, a first position with said guard means shielding the cutting edge and a second position with said guard means removed from the cutting edge to expose the same for use, hinge means between said attaching means and guard means for permitting movement of said guard means between its two positions by one of engaging said knife guard with an object and manually, said guard means being movable from its first position to its second position out in front and forward of the direction of travel of the cutting edge of the blade and may be snapped back rearward in the opposite direction of travel of the cutting edge of the blade to its first position by engagement of said guard means with some object other than that intended to be cut with the blade, whereby the guard means covers the cutting edge when in its first position and protects a user by being able to snap back automatically from its second position to its first position upon engagement with some object not intended to be cut.

17. A knife guard as in claim 16 further comprising spring means cooperating with said attaching means and guard means for holding said guard means in either of its two positions.

18. A knife guard as in claim 17, wherein said guard means comprises a plurality of elongated and cross members having at least one member attached to said attaching means, and at least some of said members being used to shield the cutting edge when in said first position.

19. A knife guard as in claim 7, wherein the knife is a razor blade and said guard means protects the cutting edge of said razor blade.

* * * * *